US011946173B2

(12) United States Patent
Earhart et al.

(10) Patent No.: US 11,946,173 B2
(45) Date of Patent: Apr. 2, 2024

(54) YARNS AND FABRICS INCLUDING MODACRYLIC FIBERS

(71) Applicant: Glen Raven, Inc., Glen Raven, NC (US)

(72) Inventors: Robert Charles Earhart, Mebane, NC (US); Mia Rauston Alberto, Greensboro, NC (US); Christopher Brent Martin, Winston-Salem, NC (US)

(73) Assignee: Glen Raven, Inc., Glen Raven, NC (US)

( * ) Notice: Subject to any disclaimer, the term of this patent is extended or adjusted under 35 U.S.C. 154(b) by 303 days.

(21) Appl. No.: 16/878,989

(22) Filed: May 20, 2020

(65) Prior Publication Data

US 2021/0363672 A1 Nov. 25, 2021

(51) Int. Cl.

| | |
|---|---|
| ***D03D 15/54*** | (2021.01) |
| ***D03D 1/00*** | (2006.01) |
| ***D03D 15/283*** | (2021.01) |
| ***D03D 15/47*** | (2021.01) |
| ***D03D 15/513*** | (2021.01) |
| ***D03D 15/533*** | (2021.01) |

(52) U.S. Cl.

CPC ..... *D03D 15/513* (2021.01); *D03D 1/00* (2013.01); *D03D 15/283* (2021.01); *D03D 15/47* (2021.01); *D03D 15/533* (2021.01); *D03D 15/54* (2021.01); *D10B 2321/101* (2013.01); *D10B 2331/021* (2013.01); *D10B 2401/16* (2013.01); *D10B 2501/04* (2013.01)

(58) Field of Classification Search

USPC ..... 428/219

See application file for complete search history.

(56) References Cited

U.S. PATENT DOCUMENTS

| | | | | |
|---|---|---|---|---|
| 3,932,127 | A | 1/1976 | D'Albignac | |
| 3,970,422 | A * | 7/1976 | Maeda | C03C 25/475 8/534 |
| 4,898,596 | A * | 2/1990 | Riggins | D06P 3/24 8/490 |
| 5,275,627 | A | 1/1994 | Cates et al. | |
| 5,306,312 | A | 4/1994 | Riggins et al. | |
| 5,427,589 | A | 6/1995 | Holsten et al. | |
| 5,534,443 | A | 7/1996 | Ohtagaki et al. | |
| 5,718,129 | A * | 2/1998 | Makiyama | D04B 1/04 139/420 A |
| 5,855,623 | A | 1/1999 | English et al. | |
| 5,885,307 | A | 3/1999 | Gadoury | |
| 6,787,228 | B2 | 9/2004 | Campbell et al. | |
| 7,065,950 | B2 * | 6/2006 | Zhu | D02G 3/047 57/255 |
| 7,157,388 | B2 | 1/2007 | Langley et al. | |
| 7,348,059 | B2 * | 3/2008 | Zhu | D02G 3/047 57/252 |
| 7,744,999 | B2 | 6/2010 | Zhu | |
| 8,069,642 | B2 * | 12/2011 | Zhu | D02G 3/047 57/255 |
| 8,069,643 | B2 * | 12/2011 | Zhu | D02G 3/443 57/255 |
| 8,133,584 | B2 * | 3/2012 | Zhu | D02G 3/047 428/196 |
| 8,652,975 | B1 | 2/2014 | Atkinson et al. | |
| 9,169,582 | B2 * | 10/2015 | Zhu | A62B 17/003 |
| 9,528,862 | B2 * | 12/2016 | Lawson, III | D04H 3/005 |
| 9,765,453 | B2 | 9/2017 | Deng et al. | |
| 10,030,326 | B2 * | 7/2018 | Hines, Jr. | D02G 3/443 |
| 10,253,435 | B2 * | 4/2019 | Zhu | D01F 6/605 |
| 10,253,437 | B2 | 4/2019 | Zhu | |
| 10,428,446 | B2 * | 10/2019 | Smith | D03D 15/513 |
| 10,441,013 | B1 | 10/2019 | Emery et al. | |
| 10,487,424 | B2 | 11/2019 | Stanhope et al. | |
| 10,662,580 | B1 | 5/2020 | Tutterow | |
| 2002/0168908 | A1 | 11/2002 | Gibson et al. | |
| 2003/0203688 | A1 | 10/2003 | Campbell et al. | |
| 2004/0077241 | A1 | 4/2004 | Campbell et al. | |
| 2005/0204487 | A1 | 9/2005 | Zhu | |
| 2005/0204718 | A1 | 9/2005 | Zhu et al. | |
| 2005/0208855 | A1 * | 9/2005 | Zhu | D02G 3/443 442/310 |
| 2006/0105658 | A1 * | 5/2006 | Patz | D03D 15/513 442/181 |

(Continued)

FOREIGN PATENT DOCUMENTS

| | | | |
|---|---|---|---|
| CA | 2472534 | A1 | 12/2004 |
| CN | 1760423 | A | 4/2006 |

(Continued)

OTHER PUBLICATIONS

"What's All the Hype about Solution-Dyed Fabric?" National Bimini Tops, Mar. 22, 2019, https://www.nationalbiminitops.com/a/solution-dyed-fabric.html. (Year: 2019).*

"ASTM D6413—Vertical Flame—Arcwear—Arc Flash, Flame, Flash Fire, and Thermal Testing and Certification." Arcwear, Sep. 22, 2020, https://www.arcwear.com/astm-d6413-vertical-flame/. (Year: 2020).*

"AATCC 61 Method 2A—Colorfastness." Arcwear, Sep. 21, 2020, https://www.arcwear.com/aatcc-61-method-2a-colorfastness/. (Year: 2020).*

"NFPA 2112." Arcwear, Sep. 24, 2020, https://www.arcwear.com/nfpa-2112/ (Year: 2020).*

"NFPA 1975." Arcwear, Sep. 19, 2020, https://www.arcwear.com/nfpa-1975/ (Year: 2020).*

(Continued)

*Primary Examiner* — Shaun R Hurley
*Assistant Examiner* — Grace Huang
(74) *Attorney, Agent, or Firm* — Myers Bigel, P.A.

(57) ABSTRACT

Yarns and fabrics that include modacrylic fibers are described herein. A yarn and/or fabric may include modacrylic fibers, meta-aramid fibers, anti-static fibers, and optionally para-aramid fibers. In some embodiments, the modacrylic fibers, meta-aramid fibers, and, if present, para-aramid fibers, may each be solution-dyed.

22 Claims, No Drawings

(56) References Cited

U.S. PATENT DOCUMENTS

| | | | | |
|---|---|---|---|---|
| 2006/0292953 | A1 | 12/2006 | Ashley et al. | |
| 2007/0207286 | A1* | 9/2007 | Craig | B29C 59/18 428/88 |
| 2008/0199651 | A1* | 8/2008 | Matsumoto | D06C 23/00 428/89 |
| 2010/0299816 | A1* | 12/2010 | Zhu | D02G 3/443 524/439 |
| 2010/0319140 | A1 | 12/2010 | Wegdam et al. | |
| 2012/0102632 | A1* | 5/2012 | Zhu | B32B 5/024 2/455 |
| 2013/0118635 | A1* | 5/2013 | Layson, Jr. | D03D 1/0035 139/420 R |
| 2014/0026303 | A1* | 1/2014 | Zhu | C08L 77/00 2/458 |
| 2014/0041107 | A1* | 2/2014 | Rose | A41D 31/26 428/221 |
| 2014/0053348 | A1* | 2/2014 | Finley | D06P 5/005 8/543 |
| 2015/0110993 | A1* | 4/2015 | Rock | D02G 3/443 524/36 |
| 2017/0067192 | A1* | 3/2017 | Rock | B32B 27/308 |
| 2017/0198419 | A1 | 7/2017 | Stanhope et al. | |
| 2018/0108826 | A1* | 4/2018 | Tajitsu | H01L 41/047 |
| 2018/0188007 | A1 | 7/2018 | Freier et al. | |
| 2018/0347079 | A1 | 12/2018 | Shimada et al. | |
| 2018/0371647 | A1 | 12/2018 | Sato et al. | |
| 2023/0175173 | A1* | 6/2023 | Alberto | D03D 15/513 442/181 |

FOREIGN PATENT DOCUMENTS

| | | | | | |
|---|---|---|---|---|---|
| CN | 101724964 | A | | 6/2010 | |
| CN | 104558392 | A | | 4/2015 | |
| CN | 104651997 | A | | 5/2015 | |
| CN | 105421116 | A | | 3/2016 | |
| CN | 105483898 | A | | 4/2016 | |
| CN | 105220336 | B | | 5/2017 | |
| CN | 105821656 | B | | 6/2017 | |
| CN | 107160251 | A | | 9/2017 | |
| CN | 107584824 | A | | 1/2018 | |
| CN | 107938107 | A | | 4/2018 | |
| CN | 107958107 | A | | 4/2018 | |
| CN | 108117750 | A | | 6/2018 | |
| CN | 108315859 | A | | 7/2018 | |
| CN | 207845911 | U | * | 9/2018 | D04B 1/16 |
| CN | 108950783 | A | | 12/2018 | |
| CN | 109680519 | A | | 4/2019 | |
| CN | 109750531 | A | | 5/2019 | |
| CN | 110644258 | A | | 1/2020 | |
| EP | 0875620 | A1 | | 11/1998 | |
| EP | 2377991 | B1 | | 10/2015 | |
| EP | 3196352 | A1 | | 7/2017 | |
| GB | 909609 | A | | 10/1962 | |
| GB | 1288136 | A | | 9/1972 | |
| GB | 1343095 | A | | 1/1974 | |
| JP | S6422971 | U | | 1/1989 | |
| JP | 3213152 | B2 | | 7/2001 | |
| JP | 3257285 | B2 | | 12/2001 | |
| JP | 3340892 | B2 | | 11/2002 | |
| JP | 6109026 | B2 | | 3/2017 | |
| JP | 6162462 | B2 | | 6/2017 | |
| JP | 6162462 | B2 | * | 7/2017 | |
| JP | 2018188753 | A | | 11/2018 | |
| KR | 101564528 | B1 | * | 10/2015 | D03D 11/00 |
| KR | 101962283 | B1 | | 3/2019 | |
| KR | 20200012579 | A | * | 2/2020 | D10B 2401/16 |
| KR | 20200012579 | A | | 2/2020 | |
| WO | WO-2004106606 | A2 | * | 12/2004 | A41D 31/0022 |
| WO | 2007014291 | A2 | | 2/2007 | |
| WO | 2008128660 | A1 | | 10/2008 | |
| WO | WO-2010141554 | A1 | * | 12/2010 | D02G 3/443 |
| WO | 2019194001 | A1 | | 10/2019 | |
| WO | 2021236871 | A1 | | 11/2021 | |
| WO | 2021236872 | A1 | | 11/2021 | |
| WO | 2021236873 | A1 | | 11/2021 | |
| WO | 2022235999 | | | 11/2022 | |

OTHER PUBLICATIONS

"ASTM F1506 / NFPA 70E." Arcwear, Sep. 19, 2020, https://www.arcwear.com/astm-f1506-nfpa-70e/. (Year: 2020).*

"NFPA 79." National Fire Protection Association. 2021, https://www.nfpa.org/codes-and-standards/all-codes-and-standards/list-of-codes-and-standards/detail?code=79 (Year: 2021).*

"CGSB 155.20." Westex. 2022. https://www.westex.com/hazards-standards/cgsb-15520#:~:text=CGSB%20155.20%20a%20national%20standard,optionally%20steam%20and%20hot%20fluids. (Year: 2022).*

"CAN/CGSB-155.22-2014 (R2019)." SCC. May 31, 2019. https://www.scc.ca/en/standardsdb/standards/27521 (Year: 2019).*

"ASTM-D434." Document Center. Apr. 14, 2005. https://www.document-center.com/standards/show/ASTM-D434 (Year: 2005).*

"AATCC TM 135." Arcwear. Sep. 19, 2020. https://www.arcwear.com/aatcc-135-dimensional-change/ (Year: 2020).*

"ASTM D2261." Arwear. Sep. 24, 2020. https://www.arcwear.com/astm-d2261-tear-resistance-tongue-method/ (Year: 2020).*

"AATCC D5034." Arcwear. Sep. 19, 2020. https://www.arcwear.com/astm-d5034-breaking-strength-grab/ (Year: 2020).*

International Search Report and the Written Opinion of the International Searching Authority corresponding to International Patent Application No. PCT/US2021/033307 (12 pages) (dated Aug. 16, 2021).

"Standard Performance Specification for Flame Resistant and Electric Arc Rated Protective Clothing Worn by Workers Exposed to Flames and Electric Arcs" ASTM International, F1506-18 (pp. 1-8) (2022).

"Standard Test Method for Breaking Strength and Elongation of Textile Fabrics (Grab Test)" ASTM International, D5034-09 (pp. 173-180) (2017).

"Standard Test Method for Flame Resistance of Textiles (Vertical Test)" ASTM International, D6413/D6413M-15 (pp. 552-563) (2016).

"Standard Test Method for Resistance to Slippage of Yarns in Woven Fabrics Using a Standard Seam" ASTM International, D 434-95 (pp. 1-3) (1995).

"Standard Test Method for Tearing Strength of Fabrics by the Tongue (Single Rip) Procedure (Constant-Rate-of-Extension Tensile Testing Machine)" ASTM International, D2261-13 (pp. 597-602) (2017).

AATCC Test Method 135-2015 "Dimensional Changes of Fabrics after Home Laundering" AATCC Technical Manual, pp. 248-251 (2018).

AATCC Test Method 61-2013 "Colorfastness to Laundering: Accelerated" AATCC Technical Manual, pp. 110-114 (2018).

CAN/CGSB-155.20-2017, National Standard of Canada "Workwear for protection against hydrocarbon flash fire and optionally steam and hot fluids" (58 pages) (2019).

Fenyvesi, E. "Modern engineering and textile-industrial fibres. Part 4" International Polymer Science and Technology, 20(7):T34-T42 (1993).

NFPA 1975 "Standard on Emergency Services Work Apparel" (38 pages) (2019).

NFPA 2112 "Standard on Flame-Resistant Clothing for Protection of Industrial Personnel Against Short-Duration Thermal Exposures from Fire" (39 pages) (2018).

NFPA 70E "Standard for Electrical Safety in the Workplace" (14 pages) (2018).

* cited by examiner

YARNS AND FABRICS INCLUDING MODACRYLIC FIBERS

FIELD

The present invention relates to yarns and fabrics that include modacrylic fibers.

BACKGROUND

Fabrics that provide flame-resistance are needed in many settings to protect workers. To increase worker compliance with wearing protective garments, fabrics that have improved properties are needed.

SUMMARY

A first aspect of the present invention is directed to a yarn comprising: a blend of fibers, the blend of fibers comprising: greater than 20% modacrylic fibers by weight of the yarn; about 20% to about 80% meta-aramid fibers by weight of the yarn; about 0.1% to about 2% anti-static fibers by weight of the yarn; and about 0% to about 10% para-aramid fibers by weight of the yarn.

Another aspect of the present invention is directed to a yarn comprising: a blend of fibers, the blend of fibers comprising: solution-dyed modacrylic fibers; solution-dyed meta-aramid fibers; anti-static fibers; and optionally solution-dyed para-aramid fibers. In some embodiments, the anti-static fibers are solution-dyed anti-static fibers.

A further aspect of the present invention is directed to a fabric comprising a yarn as described herein.

Another aspect of the present invention is directed to use of a yarn as described herein in forming a fabric and/or garment (e.g., a shirt, pant, etc.).

Another aspect of the present invention is directed to a fabric comprising: a plurality of yarns, wherein each yarn of the plurality of yarns comprises modacrylic fibers, meta-aramid fibers, anti-static fibers, and optionally para-aramid fibers, wherein the fabric comprises: greater than 20% modacrylic fibers by weight of the fabric; about 20% to about 80% meta-aramid fibers by weight of the fabric; about 0.1% to about 2% anti-static fibers by weight of the fabric; and about 0% to about 10% para-aramid fibers by weight of the fabric.

A further aspect of the present invention is directed to a fabric comprising: a plurality of yarns, wherein each yarn of the plurality of yarns comprises: solution-dyed modacrylic fibers; solution-dyed meta-aramid fibers; anti-static fibers; and optionally solution-dyed para-aramid fibers. In some embodiments, the anti-static fibers are solution-dyed anti-static fibers.

Another aspect of the present invention is directed to use of a fabric as described herein in forming a garment (e.g., a shirt, pant, etc.).

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim and/or file any new claim accordingly, including the right to be able to amend any originally filed claim to depend from and/or incorporate any feature of any other claim or claims although not originally claimed in that manner. These and other objects and/or aspects of the present invention are explained in detail in the specification set forth below. Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EXAMPLE EMBODIMENTS

The present invention is now described more fully hereinafter in which embodiments of the invention are described. This invention may, however, be embodied in many different forms and should not be construed as limited to the embodiments set forth herein; rather these embodiments are provided so that this disclosure will be thorough and complete and will fully convey the scope of the invention to those skilled in the art.

The terminology used in the description of the invention herein is for the purpose of describing particular embodiments only and is not intended to be limiting of the invention. As used in the description of the invention and the appended claims, the singular forms "a," "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the present application and relevant art and should not be interpreted in an idealized or overly formal sense unless expressly so defined herein. The terminology used in the description of the invention herein is for the purpose of describing particular embodiments only and is not intended to be limiting of the invention. All publications, patent applications, patents and other references mentioned herein are incorporated by reference in their entirety. In case of a conflict in terminology, the present specification is controlling.

Also as used herein, "and/or" refers to and encompasses any and all possible combinations of one or more of the associated listed items, as well as the lack of combinations when interpreted in the alternative ("or").

Unless the context indicates otherwise, it is specifically intended that the various features of the invention described herein can be used in any combination. Moreover, the present invention also contemplates that in some embodiments of the invention, any feature or combination of features set forth herein can be excluded or omitted. To illustrate, if the specification states that a complex comprises components A, B and C, it is specifically intended that any of A, B or C, or a combination thereof, can be omitted and disclaimed.

As used herein, the transitional phrase "consisting essentially of" (and grammatical variants) is to be interpreted as encompassing the recited materials or steps "and those that do not materially affect the basic and novel characteristic(s)" of the claimed invention. See, In re Herz, 537 F.2d 549, 551-52, 190 U.S.P.Q. 461, 463 (CCPA 1976) (emphasis in the original); see also MPEP § 2111.03. Thus, the term "consisting essentially of" as used herein should not be interpreted as equivalent to "comprising."

The term "about," as used herein when referring to a measurable value such as an amount or concentration and the like, is meant to encompass variations of ±10%, ±5%, ±1%, ±0.5%, or even ±0.1% of the specified value as well as the specified value. For example, "about X" where X is the measurable value, is meant to include X as well as variations of ±10%, ±5%, ±1%, ±0.5%, or even ±0.1% of X. A range provided herein for a measurable value may include any other range and/or individual value therein.

As used herein, the terms "increase," "increases," "increased," "increasing," and similar terms indicate an elevation in the specified parameter or value of at least about 5%, 10%, 15%, 20%, 25%, 30%, 35%, 40%, 45%, 50%, 55%, 60%, 65%, 70%, 75%, 80%, 85%, 90%, 95%, 100%, 150%, 200%, 300%, 400%, 500% or more.

As used herein, the terms "reduce," "reduces," "reduced," "reduction," "inhibit," and similar terms refer to a decrease in the specified parameter or value of at least about 5%, 10%, 15%, 20%, 25%, 30%, 35%, 40%, 45%, 50%, 55%, 60%, 65%, 70%, 75%, 80%, 85%, 90%, 95%, 97%, or 100%.

Provided according to embodiments of the present invention are yarns and fabrics including modacrylic fibers. A yarn and/or fabric of the present invention can have one or more improved properties. In some embodiments, a yarn and/or fabric of the present invention may include one or more pigmented fiber(s). A fiber (e.g., a modacrylic fiber, meta-aramid fiber, anti-static fiber, and/or para-aramid fiber) may be pigmented using techniques known to those of skill in the art. Exemplary pigmenting techniques include, but are not limited to, spun dyeing (e.g., solution dyeing or melt dyeing), gel dyeing, package dyeing, pressure dyeing, skein dyeing, space dyeing, thermal fixation, spray dyeing, and/or stock dyeing. In some embodiments, a fiber (e.g., a modacrylic fiber, meta-aramid fiber, anti-static fiber, and/or para-aramid fiber) in a yarn and/or fabric of the present invention is solution dyed. In some embodiments, a fiber (e.g., a modacrylic fiber, meta-aramid fiber, anti-static fiber, and/or para-aramid fiber) in a yarn and/or fabric of the present invention is stock dyed.

In some embodiments, a yarn of the present invention comprises a blend of modacrylic fibers, meta-aramid fibers, anti-static fibers, and optionally para-aramid fibers. In some embodiments, the blend of fibers comprises: about 20% to about 80% modacrylic fibers by weight of the yarn; about 20% to about 80% meta-aramid fibers by weight of the yarn; about 0.1% to about 2% anti-static fibers by weight of the yarn; and about 0% to about 10% para-aramid fibers by weight of the yarn. In some embodiments, a yarn of the present invention comprises a blend of fibers, the blend of fibers comprising: greater than 20% modacrylic fibers by weight of the yarn; about 20% to about 80% meta-aramid fibers by weight of the yarn; about 0.1% to about 2% anti-static fibers by weight of the yarn; and about 0% to about 10% para-aramid fibers by weight of the yarn. The yarn may comprise less than 74% meta-aramid fibers by weight of the yarn and/or the yarn may comprise greater than 20% to about 60% or 80% modacrylic fibers by weight of the yarn. In some embodiments, the blend of fibers comprises: about 40% to about 60% modacrylic fibers by weight of the yarn; about 30% to about 60% meta-aramid fibers by weight of the yarn; about 0.1% to about 2% anti-static fibers by weight of the yarn; and about 0% to about 10% para-aramid fibers by weight of the yarn. In some embodiments, the blend of fibers comprises: about 60% to about 80% modacrylic fibers by weight of the yarn; about 20% to about 40% meta-aramid fibers by weight of the yarn; about 0.1% to about 2% anti-static fibers by weight of the yarn; and about 0% to about 10% para-aramid fibers by weight of the yarn. A yarn of the present invention may be devoid of cellulosic fibers (e.g., cotton, rayon, acetate, triacetate, and/or lyocell fibers).

Modacrylic fibers may be present in the yarn in an amount of about 20% by weight of the yarn or more. In some embodiments, modacrylic fibers are present in the yarn in an amount that is greater than 20% by weight of the yarn. In some embodiments, modacrylic fibers are present in the yarn in an amount of about 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, 50%, 51%, 52%, 53%, 54%, 55%, 56%, 57%, 58%, 59%, 60%, 61%, 62%, 63%, 64%, 65%, 66%, 67%, 68%, 69%, 70%, 71%, 72%, 73%, 74%, 75%, 76%, 77%, 78%, 79%, or 80% by weight of the yarn or more. In some embodiments, the yarn comprises greater than 20% to about 60% or 80% modacrylic fibers by weight of the yarn such as about 25% to about 80%, about 25% to about 70%, about 25% to about 60%, about 30% to about 60%, about 40% to about 60%, about 50% to about 60%, greater than about 20% to about 50%, about 25% to about 50%, about 25% to about 40%, about 25% to about 30%, about 30% to about 50%, about 30% to about 40%, about 40% to about 60%, about 40% to about 50%, about 50% to about 60%, about 30% to about 70%, about 40% to about 70%, about 50% to about 70%, about 60% to about 70%, about 50% to about 75%, about 30% to about 80%, about 40% to about 80%, about 50% to about 80%, about 60% to about 80%, about 70% to about 80%, about 40% to about 80%, about 50% to about 80%, about 60% to about 80%, or about 70% to about 80% by weight of the yarn.

In some embodiments, the modacrylic fibers are solution-dyed modacrylic fibers. In some embodiments, the modacrylic fibers are stock dyed modacrylic fibers. In some embodiments, the modacrylic fibers are devoid of a pigment (i.e., natural modacrylic fibers). A yarn of the present invention may comprise stock dyed modacrylic fibers, solution-dyed modacrylic fibers and/or natural modacrylic fibers. In some embodiments, it was discovered that modacrylic fibers could be solution-dyed and incorporated into a yarn and/or fabric of the present invention without adversely affecting one or more properties (e.g., strength, flame resistance, arc resistance, color fastness, etc.) of the yarn and/or fabric. In some embodiments, by incorporating solution-dyed modacrylic fibers into a yarn and/or fabric of the present invention the amount of modacrylic fibers can be increased and/or one or more properties of the fabric and/or yarn may be improved. While modacrylic fibers are inherently flame retardant, modacrylic fibers do not possess the same strength and physical performance characteristics as other fibers such as aramid fibers (e.g., para-aramid and meta-aramid fibers), which can also be inherently flame retardant. Accordingly, it was discovered that a fiber blend having a high modacrylic content (e.g., greater than 20% modacrylic fibers by weight of the yarn or fabric) could be achieved and still provide the yarn and/or fabric with sufficient strength (e.g., tear and/or tensile strength), seam slip, flame resistance, arc resistance, and/or other performance characteristics. "Inherently flame retardant" as used herein in reference to a fiber means that the fiber has flame resistance built into its chemical structure and the fiber itself is not flammable. In some embodiments, a modacrylic fiber is self-extinguishing and does not melt or drip when exposed to a flame, optionally when exposed to a flame as performed and/or measured in accordance with ASTM F1506. In some embodiments, a modacrylic fiber does not melt or drip, has an after-flame of less than 2 seconds, and has a char length of less than 6 inches when exposed to a flame as performed and/or measured in accordance with ASTM F1506. In some embodiments, a modacrylic fiber has a limiting oxygen index (LOI) of about 28%, 29%, 30%, 31%, 32%, 33%, 34%, 35%, or more. In some embodiments, a modacrylic fiber has a LOI of about 32% or more. In some embodiments, a modacrylic fiber has a LOI of about 34% or more.

Modacrylic fibers comprise a polymer that includes 35% to 85% acrylonitrile monomer units by weight of the polymer. In some embodiments, a modacrylic fiber comprises 35% to 85% acrylonitrile monomer units by weight of the polymer, such as about 35% to about 60%, about 40% to about 80%, about 40% to about 70%, about 40% to about 60%, about 40% to about 50%, about 50% to about 85%, about 50% to about 80%, about 50% to about 70%, about 50% to about 60%, about 60% to about 80%, about 60% to about 70%, or about 70% to about 80% acrylonitrile monomer units by weight of the polymer. The polymer of a modacrylic fiber comprises one or more (e.g., 1, 2, 3, 4, 5, or more) comonomer unit(s) (e.g., a neutral and/or acid comonomer unit). A comonomer may be present in the polymer of a modacrylic fiber in an amount of about 0.1% to about 65% by weight of the polymer such as about 0.1%, 0.5%, 1%, 2%, 3%, 4%, 5%, 10%, 15%, 20%, 25%, 30%, 35%, 40%, 45%, 50%, 55%, 60% or 65% by weight of the polymer. Example comonomer units include, but are not limited to, vinyl chloride, vinylidene chloride, dichloromethane, and/or vinyl bromide. As those skilled in the art will understand, a polymer of a modacrylic fiber may be obtained by polymerizing an acrylonitrile monomer, optionally in the presence of one or more comonomers. A modacrylic fiber may have a halogen (e.g., chlorine and/or bromine) content in an amount of about 10% to about 50% by weight of the modacrylic fiber, such as about 10%, 15%, or 20% to about 25%, 30%, 35%, 40%, 45%, or 50% by weight of the modacrylic fiber. A modacrylic fiber may comprise a synergist. Exemplary synergists that may be present in a modacrylic fiber include, but are not limited to, antimony oxides such as antimony trioxide and/or antimony pentoxide. A synergist may be present in an amount of about 10% to about 50% by weight of the modacrylic fiber, such as about 10%, 15%, or 20% to about 25%, 30%, 35%, 40%, 45%, or 50% by weight of the fiber. In some embodiments, modacrylic fibers present in a yarn of the present invention are annealed modacrylic fibers, which may have reduced or no irregularities (e.g., internal fissures, fractures, pitting, etc.), deformities and/or internal stresses compared to modacrylic fibers that are not annealed such as quenched modacrylic fibers. Annealed modacrylic fibers may be achieved by a process that comprises gradually cooling the extruded modacrylic fibers optionally through a series of convective ovens/rollers. In contrast, quenched modacrylic fibers can be prepared by a process in which filaments are rapidly cooled from their melt temperature to a temperature below their glass transition phase by way of air blasts, water/chemical baths, and/or the like. The quenching process is often done in the shortest time frame and corresponding distance possible to eliminate die swell and other changes in filament size, shape and orientation.

Meta-aramid fibers may be present in the yarn in an amount of about 20% or 40% to about 80% by weight of the yarn such as about 20% to about 70%, about 20% to about 60%, about 20% to about 50%, about 20% to about 40%, about 20% to about 30%, about 30% to about 80%, about 30% to about 70%, about 30% to about 60%, about 30% to about 50%, about 30% to about 40%, about 40% to about 70%, about 40% to about 60%, about 40% to about 50%, about 50% to about 80%, about 50% to about 70%, about 50% to about 60%, about 60% to about 80%, about 60% to about 70%, or about 70% to about 80% by weight of the yarn. In some embodiments, meta-aramid fibers are present in the yarn in an amount of about 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, 50%, 51%, 52%, 53%, 54%, 55%, 56%, 57%, 58%, 59%, 60%, 61%, 62%, 63%, 64%, 65%, 66%, 67%, 68%, 69%, 70%, 71%, 72%, 73%, 74%, 75%, 76%, 77%, 78%, 79%, or 80% by weight of the yarn. In some embodiments, the yarn comprises less than 74% meta-aramid fibers by weight of the yarn such as about 20% or 40% to about 73% by weight of the yarn. In some embodiments, the meta-aramid fibers are solution-dyed meta-aramid fibers. In some embodiments, the meta-aramid fibers are stock dyed meta-aramid fibers. In some embodiments, the meta-aramid fibers are devoid of a pigment (i.e., natural meta-aramid fibers). A yarn of the present invention may comprise stock dyed meta-aramid fibers, solution-dyed meta-aramid fibers and/or natural meta-aramid fibers. In some embodiments, a meta-aramid fiber has a LOI of about 28%, 29%, 30%, 31%, 32%, 33%, 34%, 35%, or more.

Anti-static fibers may be present in the yarn in an amount of about 0.1% to about 2% by weight of the yarn such as about 0.1% to about 2%, about 0.1% to about 1.5%, about 0.1% to about 1%, about 0.1% to about 0.5%, about 0.5% to about 2%, about 0.5% to about 1.5%, about 0.5% to about 1%, about 0.5% to about 0.75%, about 1% to about 2%, about 1% to about 1.5%, or about 1.5% to 2% by weight of the yarn. In some embodiments, anti-static fibers are present in the yarn in an amount of about 0.1%, 0.2%, 0.3%, 0.4%, 0.5%, 0.6%, 0.7%, 0.8%, 0.9%, 1%, 1.1%, 1.2%, 1.3%, 1.4%, 1.5%, 1.6%, 1.7%, 1.8%, 1.9%, or 2% by weight of the yarn. In some embodiments, the anti-static fibers are solution-dyed anti-static fibers. In some embodiments, the anti-static fibers are stock dyed anti-static fibers. In some embodiments, the anti-static fibers are devoid of a pigment (i.e., natural anti-static fibers). A yarn of the present invention may comprise solution-dyed anti-static fibers, stock dyed anti-static fibers, and/or natural anti-static fibers.

Para-aramid fibers may be present in the yarn in an amount of about 0% to about 10% by weight of the yarn such as about 0.5% to about 9%, about 0.5% to about 8%, about 0.5% to about 7%, about 0.5% to about 6%, about 0.5% to about 5%, about 0.5% to about 4%, about 0.5% to about 3%, about 0.5% to about 2%, about 0.5% to about 1%, about 1% to about 10%, about 1% to about 9%, about 1% to about 8%, about 1% to about 7%, about 1% to about 6%, about 1% to about 5%, about 1% to about 4%, about 1% to about 3%, about 1% to about 2%, about 2% to about 10%, about 2% to about 9%, about 2% to about 8%, about 2% to about 7%, about 2% to about 6%, about 2% to about 5%, about 2% to about 4%, about 2% to about 3%, about 4% to about 10%, about 5% to about 10%, or about 6% to about 10% by weight of the yarn. In some embodiments, para-aramid fibers are present in the yarn in an amount of about 0%, 0.1%, 0.2%, 0.3%, 0.4%, 0.5%, 0.6%, 0.7%, 0.8%, 0.9%, 1%, 1.5%, 2%, 2.5%, 3%, 3.5%, 4%, 4.5%, 5%, 5.5%, 6%, 6.5%, 7%, 7.5%, 8%, 8.5%, 9%, 9.5%, or 10% by weight of the yarn. In some embodiments, para-aramid fibers are not present in the yarn (i.e., there are 0% para-aramid fibers by weight of the yarn). In some embodiments, the para-aramid fibers are solution-dyed para-aramid fibers. In some embodiments, the para-aramid fibers are stock dyed para-aramid fibers. In some embodiments, the para-aramid fibers are devoid of a pigment (i.e., natural para-aramid fibers). A yarn of the present invention may comprise stock dyed para-aramid fibers, solution-dyed para-aramid fibers and/or natural para-aramid fibers.

The yarn may comprise one or more (e.g., 1, 2, 3, 4, 5, or more) different types of fibers that are solution-dyed. In contrast to stock dyed fibers, solution-dyed fibers are dyed/pigmented during the spinning process of the fibers such as by introducing pigments and/or dyes (e.g., insoluble dyes) into the polymer solution or dope prior to extrusion. Stock dyed fibers are dyed/pigmented after extrusion. In some embodiments, a yarn comprises solution-dyed meta-aramid fibers, solution-dyed para-aramid fibers, anti-static fibers, and/or solution-dyed modacrylic fibers. The anti-static fibers in the yarn may be solution-dyed anti-static fibers. The yarn may comprise solution-dyed meta-aramid fibers, solution-dyed modacrylic fibers, and anti-static fibers. The yarn may comprise solution-dyed meta-aramid fibers, solution-dyed modacrylic fibers, and solution-dyed anti-static fibers. In some embodiments, the yarn comprises solution-dyed meta-aramid fibers, solution-dyed para-aramid fibers, anti-static fibers, and solution-dyed modacrylic fibers. In some embodiments, the yarn comprises solution-dyed meta-aramid fibers, solution-dyed para-aramid fibers, solution-dyed anti-static fibers, and solution-dyed modacrylic fibers. In some embodiments, the yarn comprises about 20% or more solution-dyed modacrylic fibers by weight of the yarn. In some embodiments, the yarn comprises about 20% to about 60% or 80% solution-dyed modacrylic fibers by weight of the yarn. In some embodiments, the yarn comprises greater than 20% solution-dyed modacrylic fibers by weight of the yarn. In some embodiments, the yarn comprises less than 74% solution-dyed meta-aramid fibers by weight of the yarn.

In some embodiments, a yarn of the present invention comprises about 75% or more solution-dyed fibers by weight of the yarn. The yarn may comprise about 75%, 76%, 77%, 78%, 79%, 80%, 81%, 82%, 83%, 84%, 85%, 86%, 87%, 88%, 89%, 90%, 91%, 92%, 93%, 94%, 95%, 96%, 97%, 98%, 99%, or 100% solution-dyed fibers by weight of the yarn. In some embodiments, the yarn comprises about 75% to about 100%, about 80% to about 100%, about 85% to about 100%, about 90% to about 100%, about 90% to about 98%, about 95% to about 99%, or about 95% to about 100% solution-dyed fibers by weight of the yarn. In some embodiments, the yarn comprises greater than 80%, 85%, 90%, 95%, 98%, or 99% solution-dyed fibers by weight of the yarn. In some embodiments, the yarn comprises 100% solution-dyed fibers by weight of the yarn. In some embodiments, greater than 80%, such as about 81%, 82%, 83%, 84%, 85%, 86%, 87%, 88%, 89%, 90%, 91%, 92%, 93%, 94%, 95%, 96%, 97%, 98%, 99%, or 100% of the meta-aramid fibers, para-aramid fibers, anti-static fibers, and/or modacrylic fibers present in the yarn are solution-dyed. In some embodiments, about 80% to about 100%, about 85% to about 100%, about 90% to about 100%, about 90% to about 98%, about 95% to about 99%, or about 95% to about 100% of the meta-aramid fibers, para-aramid fibers, anti-static fibers, and/or modacrylic fibers present in the yarn are solution-dyed. In some embodiments, about 100% of the meta-aramid fibers, para-aramid fibers, and modacrylic fibers present in the yarn are solution-dyed. A yarn of the present invention may comprise a plurality of fibers and the plurality of fibers may consist of anti-static fibers and solution-dyed fibers. In some embodiments, a yarn of the present invention may consist of solution-dyed fibers (e.g., solution-dyed meta-aramid fibers, solution-dyed para-aramid fibers, solution-dyed anti-static fibers, and/or solution-dyed modacrylic fibers). In some embodiments, a yarn of the present invention comprises pigmented fibers and 100% of the pigmented fibers are solution-dyed fibers (e.g., solution-dyed meta-aramid fibers, solution-dyed para-aramid fibers, solution-dyed anti-static fibers, and/or solution-dyed modacrylic fibers).

A yarn of the present invention may be a single-ply yarn or a plied yarn (e.g., a multi-ply yarn). The yarn may be a single-ply yarn having a size of about 12/1 to about 40/1. The yarn may be plied yarn having a size of about 12/2 to about 40/2. In some embodiments the yarn is a 12/1, 15/1, 17/1, 18/1, 20/1, 24/1, 30/1, or 40/1 yarn. In some embodiments, the yarn is a 30/2 or 40/2 yarn.

A yarn of the present invention may comprise one or more (e.g., 1, 2, 3 or more) fibers in different forms. For example, a fiber present in the yarn may be a staple, tow, filament, or monofilament fiber. The yarn may comprise staple fibers. In some embodiments, one or more different types of fibers in the yarn are staple fibers. In some embodiments, all fibers present in the yarn are staple fibers. Typically, a staple fiber has a length in a range from about 0.75 inches to about 1, 2, 3, 4, 5, 6, 7, 8, 9, 10, 11, 12, 13, 14, 15, 16, 17, or 18 inches, and a filament fiber has any suitable length (e.g., greater than 18 inches to about 2, 4, 6, 8, 10, 100, 200, 1,000, 10,000, or 20,000, 30,000 yards or infinite length). In some embodiments, a yarn of the present invention comprises staple fibers having a length of about 10 mm to about 100 mm, about 20 mm to about 80 mm, about 30 mm to about 60 mm, about 40 mm to about 70 mm, about 40 mm to about 60 mm, or about 25 mm to about 60 mm. In some embodiments, the yarn comprises staple fibers having a length of about 50 mm to about 55 mm.

A yarn of the present invention may comprise fibers (e.g., staple fibers) having a linear density (dtex) of about 1 dtex or more such as about 1 to about 3, about 1.5 to about 2, about 1 to about 2, about 1.5 to about 2.5, or about 2 to about 3 dtex. In some embodiments, the yarn comprises fibers having a linear density of about 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3, 3.1, 3.2, 3.3, 3.4, 3.5, 3.6, 3.7, 3.8, 3.9, or 4 dtex or more. In some embodiments, the yarn comprises fibers (e.g., staple fibers such as those having a length of about 50 mm to about 55 mm) having a linear density of about 1.5 to about 2 dtex.

A yarn of the present invention may comprise one or more (e.g., 1, 2, 3, 4, or more) different fibers having a LOI of 20% or more, optionally as measured in accordance with ASTM D2863, ISO 4589-2, and/or NES 714. In some embodiments, the yarn comprises fibers having a LOI of about 20%, 21%, 22%, 23%, 24%, 25%, 26%, 2'7%, 28%, 29%, 30%, 31%, 32%, 33%, 34%, 35%, or more. In some embodiments, the yarn comprises one or more fibers having a LOI of 22% or more. In some embodiments, the yarn comprises one or more fibers having a LOI of 25% or more. In some embodiments, the yarn comprises one or more fibers having a LOI of 28% or more. In some embodiments, the yarn comprises at least 1 or 2 different types of fibers that have a LOI of 28% or more. In some embodiments, the yarn comprises modacrylic fibers and meta-aramid fibers that each have a LOI of 28% or more.

A yarn comprising a blend of fibers as described herein may be prepared using methods known to those of skill in the art. A "blend of fibers" as used herein refers to a plurality of two or more different types of fibers. In some embodiments, one or more different types of fibers are provided in a given weight percentage, blended, combed, and/or formed into a yarn of the present invention. Methods of forming a yarn are known to those of skill in the art and include, but are not limited to, drawing, drafting, spinning, and/or twisting fibers into a sliver and/or yarn. A yarn of the present invention may be spun using methods known to those of skill in the art such as, but not limited to, ring spinning, vortex spinning, core spinning, air jet spinning and/or texturizing. In some embodiments, a yarn of the present invention may be ring spun or vortex spun. Fibers present in a yarn of the present invention (e.g., modacrylic fibers, meta-aramid fibers, anti-static fibers, and/or para-aramid fibers) may be uniformly entangled and/or respective fibers present in the yarn may be arranged parallel to one or more different fibers in the yarn along the Z and or X axis/helix of the yarn. In some embodiments, a yarn of the present invention may be plied or twisted, which may increase the strength of the yarn compared to the strength of the yarn prior to plying or twisting.

A yarn of the present invention may have a denier of about 200 or more such as about 200, 250, 300, 350, 400, 450, 500 or more. The yarn may have a Z twist of about 20 to about 26 and/or a S twist of about 13 to about 19, each optionally as measured in accordance with ASTM D1423. In some embodiments, a yarn has a Z twist of about 20, 21, 22, 23, 24, 25, or 26 and/or a S twist of about 13, 14, 15, 16, 17, 18, or 19, each optionally as measured in accordance with ASTM D1423. A yarn of the present invention may have a break strength of about 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, or 3 lbs/breaking force, optionally on average, and/or an elongation of about 10%, 11%, 12%, 13%, 14%, 15%, 16%, 17%, 18%, 19%, 20%, 21%, 22%, 23%, 24%, 25%, 26%, 27%, 28%, 29%, or 30%, optionally on average, each optionally as measured in accordance with ASTM D2256. In some embodiments, the yarn has a break strength of about 1, 1.2, 1.4, or 1.6, 1.7, 1.8, 1.9, 2, 2.1, 2.2, 2.3, 2.4, 2.5, 2.6, 2.7, 2.8, 2.9, or 3 lbs/breaking force, optionally on average, and/or an elongation of about 10%, 11%, 12%, 13%, 14%, 15%, 16%, 17%, 18%, 19%, 20%, 21%, 22%, 23%, 24%, 25%, 26%, 27%, 28%, 29%, or 30%, optionally on average, each optionally as measured in accordance with ASTM D2256. A yarn of the present invention may have a shrinkage of about 2% or less, such as about 1.9%, 1.8%, 1.7%, 1.6%, 1.5%, 1.4%, 1.3%, 1.2%, 1.1%, 1%, 0.9%, 0.8%, 0.7%, 0.6%, 0.5%, 0.4%, 0.3%, 0.2%, 0.1% or less, optionally as measured in accordance with ASTM D2259.

One or more yarn(s) of the present invention may be used to form a fabric of the present invention. In some embodiments, a yarn of the present invention is woven or knit to form a fabric and/or a garment (e.g., a shirt, pant, etc.). A fabric of the present invention may be a woven fabric. Woven fabrics are known to those of skill in the art and include, but are not limited to, a plain weave, twill weave (e.g., right hand twill), broken twill weave, ripstop weave, satin weave, or basketweave fabric. In some embodiments, a fabric of the present invention may be a knit. Knit fabrics are known to those of skill in the art and include, but are not limited to, interlock, single jersey, double jersey, warp, rib, and/or modified welt knits. A fabric and/or garment of the present invention may be a single layer (e.g., a single knit or woven layer) or may comprise multiple (e.g., 2 or more) layers.

Fabrics of the present invention may comprise a yarn of the present invention. In some embodiments, a fabric of the present invention comprises one or more yarn(s) of the present invention in an amount of about 80%, 81%, 82%, 83%, 84%, 85%, 86%, 87%, 88%, 89%, 90%, 91%, 92%, 93%, 94%, 95%, 96%, 97%, 98%, 99%, or 100% by weight of the fabric. In some embodiments, a fabric of the present invention comprises one or more yarn(s) of the present invention in an amount of about 80%, 81%, 82%, 83%, 84%, 85%, 86%, 87%, 88%, 89%, 90%, 91%, 92%, 93%, 94%, 95%, 96%, 97%, 98%, 99%, or 100% of the total amount of yarns present in the fabric. In some embodiments, the fabric comprises a yarn of the present invention in the warp direction and/or fill direction. A plurality of yarns of the present invention may be arranged in a random manner in a fabric of the present invention or a pattern. For example, in some embodiments, a plurality of yarns of the present invention are woven together such as in a plain weave, twill weave, satin weave, or basketweave, or are knit together.

According to some embodiments of the present invention, provided is a fabric comprising a yarn, the yarn comprising a blend of fibers that comprises: about 20% to about 80% modacrylic fibers by weight of the yarn; about 20% to about 80% meta-aramid fibers by weight of the yarn; about 0.1% to about 2% anti-static fibers by weight of the yarn; and about 0% to about 10% para-aramid fibers by weight of the yarn. In some embodiments, the fabric comprises a yarn comprising a blend of fibers, the blend of fibers comprising: greater than 20% modacrylic fibers by weight of the yarn; about 20% to about 80% meta-aramid fibers by weight of the yarn; about 0.1% to about 2% anti-static fibers by weight of the yarn; and about 0% to about 10% para-aramid fibers by weight of the yarn. In some embodiments, the fabric comprise a yarn comprising less than 74% meta-aramid fibers by weight of the yarn and/or greater than 20% to about 60% or 80% modacrylic fibers by weight of the yarn. A fabric of the present invention includes a fiber blend having a high modacrylic content (e.g., greater than 20% modacrylic fibers by weight of the fabric) and the fabric provides sufficient strength (e.g., tear and/or tensile strength), seam slip, flame resistance, arc resistance, and/or other performance characteristics of the fabric. A fabric of the present invention may be devoid of cellulosic fibers (e.g., cotton, rayon, acetate, triacetate, and/or lyocell fibers).

In some embodiments, a fabric of the present invention comprises: a plurality of yarns, wherein each yarn of the plurality of yarns comprises modacrylic fibers, meta-aramid fibers, anti-static fibers, and optionally para-aramid fibers, and the fabric comprises: greater than 20% modacrylic fibers by weight of the fabric; about 20% to about 80% meta-aramid fibers by weight of the fabric; about 0.1% to about 2% anti-static fibers by weight of the fabric; and about 0% to about 10% para-aramid fibers by weight of the fabric. In some embodiments, the fabric comprises: about 40% to about 60% modacrylic fibers by weight of the fabric; about 30% to about 60% meta-aramid fibers by weight of the fabric; about 0.1% to about 2% anti-static fibers by weight of the fabric; and about 0% to about 10% para-aramid fibers by weight of the fabric. In some embodiments, the fabric comprises: about 60% to about 80% modacrylic fibers by weight of the fabric; about 20% to about 40% meta-aramid fibers by weight of the fabric; about 0.1% to about 2% anti-static fibers by weight of the fabric; and about 0% to about 10% para-aramid fibers by weight of the fabric.

Modacrylic fibers may be present in the fabric in an amount of about 20% by weight of the fabric or more. In some embodiments, modacrylic fibers are present in the fabric in an amount that is greater than 20% by weight of the fabric. In some embodiments, modacrylic fibers are present in the fabric in an amount of about 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, 50%, 51%, 52%, 53%, 54%, 55%, 56%, 57%, 58%, 59%, 60%, 61%, 62%, 63%, 64%, 65%, 66%, 67%, 68%, 69%, 70%, 71%, 72%, 73%, 74%, 75%, 76%, 77%, 78%, 79%, or 80% by weight of the fabric or more. In some embodiments, the fabric comprises greater than 20% to about 60% or 80% modacrylic fibers by weight of the fabric such as about 25% to about 80%, about 25% to about 70%, about 25% to about 60%, about 30% to about 60%, about 40% to about 60%, about 50% to about 60%, greater than about 20% to about 50%, about 25% to about 50%, about 25% to about 40%, about 25% to about 30%, about 30% to about 50%, about 30% to about 40%, about 40% to about 60%, about 40% to about 50%, about 50% to about 60%, about 30% to about 70%, about 40% to about 70%, about 50% to about 70%, about 60% to about 70%, about 50% to about 75%, about 30% to about 80%, about 40% to about 80%, about 50% to about 80%, about 60% to about 80%, about 70% to about 80%, about 40% to about 80%, about 50% to about 80%, about 60% to about 80%, or about 70% to about 80% by weight of the fabric. In some embodiments, the modacrylic fibers in the fabric comprise solution-dyed modacrylic fibers. In some embodiments, the modacrylic fibers in the fabric comprise stock dyed modacrylic fibers. In some embodiments, the modacrylic fibers in the fabric comprise natural modacrylic fibers. Modacrylic fibers as described herein may be included in a fabric of the present invention. In some embodiments, the fabric comprises a modacrylic fiber having a LOI of about 28%, 29%, 30%, 31%, 32%, 33%, 34%, 35%, or more. In some embodiments, the fabric comprises a modacrylic fiber having a LOI of about 34% or more.

Meta-aramid fibers may be present in the fabric in an amount of about 20% or 40% to about 80% by weight of the fabric such as about 20% to about 70%, about 20% to about 60%, about 20% to about 50%, about 20% to about 40%, about 20% to about 30%, about 30% to about 80%, about 30% to about 70%, about 30% to about 60%, about 30% to about 50%, about 30% to about 40%, about 40% to about 70%, about 40% to about 60%, about 40% to about 50%, about 50% to about 80%, about 50% to about 70%, about 50% to about 60%, about 60% to about 80%, about 60% to about 70%, or about 70% to about 80% by weight of the fabric. In some embodiments, meta-aramid fibers are present in the fabric in an amount of about 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, 50%, 51%, 52%, 53%, 54%, 55%, 56%, 57%, 58%, 59%, 60%, 61%, 62%, 63%, 64%, 65%, 66%, 67%, 68%, 69%, 70%, 71%, 72%, 73%, 74%, 75%, 76%, 77%, 78%, 79%, or 80% by weight of the fabric. In some embodiments, the fabric comprises less than 74% meta-aramid fibers by weight of the fabric such as about 20% or 40% to about 73% by weight of the fabric. In some embodiments, the meta-aramid fibers in the fabric comprise solution-dyed meta-aramid fibers. In some embodiments, the meta-aramid fibers in the fabric are stock dyed meta-aramid fibers. In some embodiments, the meta-aramid fibers in the fabric are natural meta-aramid fibers. A fabric of the present invention may comprise stock dyed meta-aramid fibers, solution-dyed meta-aramid fibers and/or natural meta-aramid fibers. In some embodiments, a meta-aramid fiber has a LOI of about 28%, 29%, 30%, 31%, 32%, 33%, 34%, 35%, or more. Meta-aramid fibers as described herein may be included in a fabric of the present invention.

Anti-static fibers may be present in the fabric in an amount of about 0.1% to about 2% by weight of the fabric such as about 0.1% to about 1.5%, about 0.1% to about 1%, about 0.1% to about 0.5%, about 0.5% to about 2%, about 0.5% to about 1.5%, about 0.5% to about 1%, about 0.5% to about 0.75%, about 1% to about 2%, about 1% to about 1.5%, or about 1.5% to about 2% by weight of the fabric. In some embodiments, anti-static fibers are present in the fabric in an amount of about 0.1%, 0.2%, 0.3%, 0.4%, 0.5%, 0.6%, 0.7%, 0.8%, 0.9%, 1%, 1.1%, 1.2%, 1.3%, 1.4%, 1.5%, 1.6%, 1.7%, 1.8%, 1.9%, or 2% by weight of the fabric. In some embodiments, the anti-static fibers in the fabric comprise solution-dyed anti-static fibers. In some embodiments, the anti-static fibers present in the fabric are stock dyed anti-static fibers. In some embodiments, the anti-static fibers present in the fabric are natural anti-static fibers. A fabric of the present invention may comprise solution-dyed anti-static fibers, stock dyed anti-static fibers, and/or natural anti-static fibers. Anti-static fibers as described herein may be included in a fabric of the present invention.

Para-aramid fibers may be present in the fabric in an amount of about 0% to about 10% by weight of the fabric such as about 0.5% to about 9%, about 0.5% to about 8%, about 0.5% to about 7%, about 0.5% to about 6%, about 0.5% to about 5%, about 0.5% to about 4%, about 0.5% to about 3%, about 0.5% to about 2%, about 0.5% to about 1%, about 1% to about 10%, about 1% to about 9%, about 1% to about 8%, about 1% to about 7%, about 1% to about 6%, about 1% to about 5%, about 1% to about 4%, about 1% to about 3%, about 1% to about 2%, about 2% to about 10%, about 2% to about 9%, about 2% to about 8%, about 2% to about 7%, about 2% to about 6%, about 2% to about 5%, about 2% to about 4%, about 2% to about 3%, about 4% to about 10%, about 5% to about 10%, or about 6% to about 10% by weight of the fabric. In some embodiments, para-aramid fibers are present in the fabric in an amount of about 0%, 0.1%, 0.2%, 0.3%, 0.4%, 0.5%, 0.6%, 0.7%, 0.8%, 0.9%, 1%, 1.5%, 2%, 2.5%, 3%, 3.5%, 4%, 4.5%, 5%, 5.5%, 6%, 6.5%, 7%, 7.5%, 8%, 8.5%, 9%, 9.5%, or 10% by weight of the fabric. In some embodiments, para-aramid fibers are not present in the fabric (i.e., there are 0% para-aramid fibers by weight of the fabric). In some embodiments, the para-aramid fibers in the fabric comprise solution-dyed para-aramid fibers. In some embodiments, the para-aramid fibers in the fabric are stock dyed para-aramid fibers. In some embodiments, the para-aramid fibers in the fabric are natural para-aramid fibers. A fabric of the present invention may comprise stock dyed para-aramid fibers, solution-dyed para-aramid fibers and/or natural para-aramid fibers. Para-aramid fibers as described herein may be included in a fabric of the present invention.

The fabric may comprise one or more (e.g., 1, 2, 3, 4, 5, or more) different types of fibers that are solution-dyed. In some embodiments, the fabric comprises solution-dyed meta-aramid fibers, solution-dyed para-aramid fibers, anti-static fibers, and/or solution-dyed modacrylic fibers. In some embodiments, the fabric comprises solution-dyed meta-aramid fibers, solution-dyed para-aramid fibers, solution-dyed anti-static fibers, and/or solution-dyed modacrylic fibers. The fabric may comprise solution-dyed meta-aramid fibers, solution-dyed modacrylic fibers, and anti-static fibers. In some embodiments, the fabric comprises solution-dyed meta-aramid fibers, solution-dyed para-aramid fibers, anti-static fibers, and solution-dyed modacrylic fibers. In some embodiments, the fabric comprises about 20% or more solution-dyed modacrylic fibers by weight of the fabric. In some embodiments, the fabric comprises about 20% to about 60% or 80% solution-dyed modacrylic fibers by weight of the fabric. In some embodiments, the fabric comprises greater than 20% solution-dyed modacrylic fibers by weight of the fabric. In some embodiments, the fabric comprises less than 74% solution-dyed meta-aramid fibers by weight of the fabric.

In some embodiments, a fabric of the present invention comprises about 75% or more solution-dyed fibers by weight of the fabric. The fabric may comprise about 75%, 76%, 77%, 78%, 79%, 80%, 81%, 82%, 83%, 84%, 85%, 86%, 87%, 88%, 89%, 90%, 91%, 92%, 93%, 94%, 95%, 96%, 97%, 98%, 99%, or 100% solution-dyed fibers by weight of the fabric. In some embodiments, the fabric comprises about 75% to about 100%, about 80% to about 100%, about 85% to about 100%, about 90% to about 100%, about 90% to about 98%, about 95% to about 99%, or about 95% to about 100% solution-dyed fibers by weight of the fabric. In some embodiments, the fabric comprises greater than 80%, 85%, 90%, 95%, 98%, or 99% solution-dyed fibers by weight of the fabric. In some embodiments, the fabric comprises 100% solution-dyed fibers by weight of the fabric. In some embodiments, greater than 80%, such as about 81%, 82%, 83%, 84%, 85%, 86%, 87%, 88%, 89%, 90%, 91%, 92%, 93%, 94%, 95%, 96%, 97%, 98%, 99%, or 100% of the meta-aramid fibers, para-aramid fibers, anti-static fibers, and/or modacrylic fibers present in the fabric are solution-dyed. In some embodiments, about 80% to about 100%, about 85% to about 100%, about 90% to about 100%, about 90% to about 98%, about 95% to about 99%, or about 95% to about 100% of the meta-aramid fibers, para-aramid fibers, anti-static fibers, and/or modacrylic fibers present in the fabric are solution-dyed. In some embodiments, about 100% of the meta-aramid fibers, para-aramid fibers, and modacrylic fibers present in the fabric are solution-dyed. In some embodiments, about 100% of the meta-aramid fibers, para-aramid fibers, anti-static fibers, and modacrylic fibers present in the fabric are solution-dyed. A fabric of the present invention may comprise a plurality of fibers and the plurality of fibers may consist of anti-static fibers and solution-dyed fibers. A fabric of the present invention may comprise a plurality of fibers and the plurality of fibers may consist of solution-dyed fibers (e.g., solution-dyed meta-aramid fibers, solution-dyed para-aramid fibers, solution-dyed anti-static fibers, and/or solution-dyed modacrylic fibers). In some embodiments, a fabric of the present invention comprises pigmented fibers and 100% of the pigmented fibers are solution-dyed fibers (e.g., solution-dyed meta-aramid fibers, solution-dyed para-aramid fibers, solution-dyed anti-static fibers, and/or solution-dyed modacrylic fibers).

A fabric of the present invention may comprise one or more single-ply yarn(s) and/or one or more plied yarn(s) (e.g., one or more multi-ply yarn(s)). The fabric may comprise a single-ply yarn having a size of about 12/1 to about 40/1. The fabric may comprise a plied yarn having a size of about 12/2 to about 40/2. In some embodiments, the fabric comprises a 12/1, 15/1, 17/1, 18/1, 20/1, 24/1, 30/1, and/or 40/1 yarn. In some embodiments, the fabric comprises a 30/2 and/or 40/2 yarn. In some embodiments, the fabric comprises 30/2 yarns in the warp direction and/or fill direction. In some embodiments, the fabric comprises 40/2 yarns in the warp direction and/or fill direction.

In some embodiments, a fabric of the present invention may have a basis weight in a range of about 2 ounces per square yard (osy) to about 15 osy such as about 2 to about 12, about 4 to about 12, about 6 to about 12, about 10 to about 12, about 4 to about 10, or about 8 to about 10 osy. In some embodiments, the fabric has a basis weight of about 4.5 osy to about 10 osy. In some embodiments, the fabric has a basis weight of about 2, 2.5, 3, 3.5, 4, 4.5, 5, 5.5, 6, 6.5, 7, 7.5, 8, 8.5, 9, 9.5, 10, 10.5, 11, 11.5, or 12 osy or more. In some embodiments, the fabric has a basis weight of about 5.3 osy to about 5.7 osy, about 6.4 osy to about 6.6 osy, or about 7.5 osy to about 8.1 osy. In some embodiments, the fabric has a basis weight of about 4.5, 4.7, 5.3, 5.5, 5.7, 6.0, 6.2, 6.4, 6.5, 6.6, 7.0, 7.5, 7.7, 8.0, or 8.1 osy.

A fabric of the present invention may have an improved and/or increased protection to weight ratio compared to a fabric not in accordance with the present invention (e.g., a control fabric). For example, in some embodiments, a fabric of the present invention may have a protection to weight ratio of about 1 or more (arc rating (cal/cm$^2$) as measured in accordance with NFPA 70E:weight of the fabric). In some embodiments, a fabric of the present invention may have a protection to weight ratio of about 1, 1.1, 1.2, 1.3, 1.4, 1.5, 1.6, 1.7, 1.8, 1.9, 2, or more (arc rating (cal/cm$^2$) as measured in accordance with NFPA 70E:weight of the fabric). In some embodiments, a fabric of the present invention may have a protection to weight ratio of about 1.5 or more such as about 1.5 to about 1.6, 1.7, 1.8, 1.9, or 2 (arc rating (cal/cm$^2$) as measured in accordance with NFPA 70E:weight of the fabric). It is difficult to provide a light weight fabric having the necessary flame resistance and/or arc resistance. A light weight fabric having a high protection rating can have the advantage of increased user compliance. In some embodiments, a fabric of the present invention has a basis weight of about 2 or 4.5 ounces per square yard (osy) to about 5, 5.5, 6, 6.5, 7, 7.5, or 8 osy and is a category 2 fabric (i.e., has an arc rating that satisfies the arc rating requirement for PPE in category 2 (e.g., has an arc rating of at least 8.0 cal/cm$^2$ as measured in accordance with ASTM F1959 and/or ASTM F1506)). In some embodiments, a fabric of the present invention has a basis weight of about 6.6 osy or less and is a category 2 fabric. In some embodiments, a fabric of the present invention has a basis weight of about 5.3 osy to about 6.6 osy and is a category 2 fabric.

In some embodiments, a fabric of the present invention may have a total denier in the warp and/or weft direction of about 100 to about 500, about 150 to about 400, or about 300 to about 400. In some embodiments, the fabric has a total denier in the warp and/or weft direction of about 100, 150, 200, 250, 300, 350, 400, 450, or 500.

A fabric of the present invention may have about 20 to about 80 picks per inch (PPI) such as about 20 to about 50, about 30 to about 60, about 30 to about 50, about 30 to about 40, about 40 to about 70, about 40 to about 60, about 40 to about 50, about 50 to about 70, about 50 to about 60, about 60 to about 80, about 60 to about 70, about 70 to about 80, about 55 to about 70, or about 55 to about 65 PPI. In some embodiments, the fabric has a PPI of about 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80 or more. In some embodiments, the fabric has about 52 to about 70 PPI. As one of skill in the textile industry would understand, picks per inch, or PPI, is the number of weft yarns per inch of the fabric and is measured in the warp direction of the fabric.

A fabric of the present invention may be heat set with standard textile techniques, optionally with or without a chemical. A fabric of the present invention may comprise a finish on at least one surface of the fabric. A finish may be present on and/or in a fabric of the present invention in an amount of up to 3% of the total weight of the finished fabric. In some embodiments, a yarn and/or fabric of the present invention is devoid of a flame retardant.

A fabric of the present invention may have one or more (e.g., 1, 2, 3, 4, or more) improved properties compared to a control fabric. A "control fabric" as used herein refers to a current commercial fabric and/or a fabric in the same form as a fabric of the present invention that it is being compared to, but that is different in a certain manner (e.g., the control fabric is devoid of a yarn of the present invention). An exemplary control fabric may comprise 20% or less modacrylic fibers by weight of the fabric; about 40% to about 80% meta-aramid fibers by weight of the fabric; about 0% to about 10% para-aramid fibers by weight of the fabric; and about 0.1% to about 2% anti-static fibers by weight of the fabric. Another exemplary control fabric is one that is devoid of solution-dyed modacrylic fibers such as a fabric that is devoid of solution-dyed modacrylic fibers, but the control fabric comprises modacrylic fibers that are not solution-dyed; solution-dyed meta-aramid fibers; anti-static fibers; and optionally solution-dyed para-aramid fibers. In some embodiments, the control fabric that is devoid of solution-dyed modacrylic fibers comprises modacrylic fibers that are not solution-dyed; solution-dyed meta-aramid fibers; solution-dyed anti-static fibers; and optionally solution-dyed para-aramid fibers.

A yarn and/or fabric of the present invention may be flame-resistant. "Flame-resistant" as used herein in reference to a yarn or fabric refers to a yarn or fabric that, upon exposure to an external source of ignition (e.g., a flame or electric arc flash), burns slowly or self-extinguishes after removal of the external source of ignition. In some embodiments, a flame-resistant yarn or fabric does not melt or drip, has an after-flame of less than 2 seconds, and has a char length of less than 6 inches when tested in accordance with ASTM F1506 and/or ASTM D6413 and/or does not melt or drip, has an after-flame of less than 2 seconds, and has a char length of less than 6 inches after 25 launderings as tested in accordance with ASTM D6413. In some embodiments, the fabric is flame-resistant and the fabric meets or exceeds the requirements set forth in ASTM D6413. In some embodiments, the fabric is UL compliant and/or the fabric meets or exceeds the requirements set forth in ASTM D6413, NFPA 70E, NFPA 2112, ASTM F1506, NFPA 1975, NFPA 1979, Canadian Standard CGSB 155.20, and/or Canadian Standard CGSB 155.22/22. In some embodiments, the fabric meets or exceeds the requirements set forth in NFPA 1975, NFPA 1979 and Canadian Standard CGSB 155.22.

In some embodiments, a fabric of the present invention has improved flame resistance compared to a control fabric. Flame resistance may be measured in accordance with ASTM D6413, ASTM F1506, ASTM D2261, and/or ASTM D5034. In some embodiments, the fabric, when tested in accordance with ASTM D6413 and/or ASTM F1506, has a char length of less than about 6, 5.5, 5, 4.5, 4, 3.5, 3, 2.5, 2, 1.5, 1, or 0.5 inches. In some embodiments, the fabric after 10, 25, 50, 75, 100, 125, 150, or more launderings (e.g., industrial launderings and/or wash cycles), when tested in accordance with AATCC 135, Method 3, V, A, iii, ASTM D6413, and/or ASTM F1506, has a char length of less than about 6, 5.5, 5, 4.5, 4, 3.5, 3, 2.5, 2, 1.5, 1, or 0.5 inches. In some embodiments, the fabric, when tested in accordance with AATCC 135, Method 3, V, A, iii, ASTM D6413, and/or ASTM F1506, has a char length about 0.5, 1, or 1.5 inches to about 2, 2.25, 2.5, or 3 inches, optionally after 25 launderings. In some embodiments, the fabric, when tested in accordance with ASTM D6413 and/or ASTM F1506, has an after-flame and/or self-extinguishes within less than about 2, 1.9, 1.8, 1.7, 1.6, 1.5, 1.4, 1.3, 1.2, 1.1, 1, 0.9, 0.8, 0.7, 0.6, or 0.5 seconds. In some embodiments, the fabric after 10, 25, 50, 75, 100, 125, 150, or more launderings, when tested in accordance with AATCC 135, Method 3, V, A, iii, ASTM D6413, and/or ASTM F1506, has an after-flame and/or self-extinguishes within less than about 2, 1.9, 1.8, 1.7, 1.6, 1.5, 1.4, 1.3, 1.2, 1.1, 1, 0.9, 0.8, 0.7, 0.6, 0.5 seconds. In some embodiments, the fabric, when tested in accordance with AATCC 135, Method 3, V, A, iii, ASTM D6413, and/or ASTM F1506, has an after-flame and/or self-extinguishes of about 0 or 0.5 seconds to about 1 or 1.5 seconds, optionally after 25 launderings. The fabric, when tested in accordance with AATCC 135, Method 3, V, A, iii, ASTM D6413, and/or ASTM F1506, may have a char length of less than about 6 inches and may self-extinguish in less than about 2 seconds, optionally after 0, 10, 25, 50, 75, 100, 125, 150, or more launderings.

In some embodiments, a fabric of the present invention has an improved arc rating compared to a control fabric. Arc rating for a fabric may be measured in accordance with ASTM F1959 and/or ASTM F1506. In some embodiments, the fabric has an arc rating of about 4, 8, 10, 15, 20, 25, 30, 35, 40, 45, 50 cal/cm$^2$ or more, optionally as measured in accordance with ASTM F1959 and/or ASTM F1506. In some embodiments, the fabric has an arc rating of at least about 9.5 or 10.1 cal/cm$^2$, optionally as measured in accordance with ASTM F1959 and/or ASTM F1506. In some embodiments, the fabric has an arc rating that satisfies the arc rating requirement for personal protective equipment (PPE) in category 1 (e.g., has an arc rating of at least 4.0 cal/cm$^2$ as measured in accordance with ASTM F1959 and/or ASTM F1506). In some embodiments, the fabric has an arc rating that satisfies the arc rating requirement for PPE in category 2 (e.g., has an arc rating of at least 8.0 cal/cm$^2$ as measured in accordance with ASTM F1959 and/or ASTM F1506). In some embodiments, the fabric has an arc rating that satisfies the arc rating requirement for PPE in category 3 (e.g., has an arc rating of at least 25 cal/cm$^2$ as measured in accordance with ASTM F1959 and/or ASTM F1506). In some embodiments, the fabric has an arc rating that satisfies the arc rating requirement for PPE in category 4 (e.g., has an arc rating of at least 40 cal/cm$^2$ as measured in accordance with ASTM F1959 and/or ASTM F1506). In some embodiments, the fabric is a category 1, 2, 3, or 4 PPE fabric as measured in accordance with ASTM F1959 and/or ASTM F1506.

A fabric of the present invention may have a color, strength (e.g., tear strength and/or tensile strength), seam slippage, crock, size, flame resistance, and/or arc-flash resistance after about 10, 25, 50, 75, 100, 150, 160, 200, or more launderings that is substantially the same as (e.g., within about +/−10% of) the color, strength, seam slippage, crock, size, flame resistance, and/or arc-flash resistance of the fabric prior to laundering.

Color or color fastness of the fabric may be measured in accordance with TM AATCC 16E. In some embodiments, the fabric may have a rating of 3, 3.5, 4, 4.5, or 5 as measured in accordance with TM AATCC 16E. A fabric having a dark shade (e.g., navy, black, etc.) may have a rating of at least 3 as measured in accordance with TM AATCC 16E. A fabric having a light shade (e.g., tan, ecru, light gray, etc.) may have a rating of at least 4 as measured in accordance with TM AATCC 16E. The fabric may have a laundering rating of at least 4 as measured in accordance with TM AATCC 61 2A. In some embodiments, the fabric has a laundering rating of about 4, 4.5, or 5 as measured in accordance with TM AATCC 61 2A. In some embodiments, the fabric may have a crocking rating of at least 4 as measured in accordance with TM AATCC 8. In some embodiments, the fabric has a crocking rating of about 4, 4.5, 5, 5.5, or 6, as measured in accordance with TM AATCC 8.

In some embodiments, the fabric may shrink in length and/or width direction after a laundering (e.g., after 1, 10, 25, 50, 75, 100, 150, 160, 200, or more launderings) by less than about 3%, 2.5%, 2%, 1.5%, 1%, or 0.5%, optionally as measured in accordance with TM AATCC 135, method 3, V, A, iii. In some embodiments, the fabric may shrink in length and/or width direction after 10 or 25 launderings (e.g., wash cycles) by less than about 3%, 2.75%, 2.5%, 2.25%, 2%, 1.75%, 1.5%, 1.25%, 1%, 0.7%, or 0.5% as measured in accordance with TM AATCC 135, method 3, V, A, iii. In some embodiments, a fabric of the present invention has improved shrinkage in the length and/or width direction compared to the shrinkage in the length and/or width direction of a control fabric. For example, in some embodiments, the fabric has reduced (e.g., reduced by about 2%, 5%, 10%, 15%, 20%, or more) shrinkage in the length and/or width direction of the fabric compared to the shrinkage of a control fabric in length and/or width direction.

A fabric of the present invention may have a seam slippage in the warp and/or fill direction of greater than 50 pound-force (lbf) such as about 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, or 85 lbf, or more, optionally as measured in accordance with ASTM D434. In some embodiments, the fabric has a seam slippage in the warp direction of about 62 lbf or more such as about 62, 63, 64, 65, 66, 67, 68, 69, 70, 71, 72, 73, 74, 75, 76, 77, 78, 79, 80, 81, 82, 83, 84, or 85 lbf, or more, optionally as measured in accordance with ASTM D434. In some embodiments, the fabric has a seam slippage in the fill direction of about 51 lbf or more such as about 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, or 85 lbf, or more, optionally as measured in accordance with ASTM D434. In some embodiments, a fabric of the present invention has a seam slippage in the warp and/or fill direction that is improved and/or increased (e.g., by at least about 5%, 10%, 15%, 20%, 25%, 30%, or more) compared to the seam slippage of a control fabric.

A fabric of the present invention may have tear strength in the warp and/or fill direction of about 7.5 lbf or more, optionally as measured in accordance with ASTM D2261. In some embodiments, the fabric may have a tear strength in the warp and/or fill direction of about 7.5, 8, 8.5, 9, 9.5, 10, 10.5, 11, 11.5, 12, 12.5, 13, 13.5, 14, 14.5, 15, 15.5, 16, 16.5, 17, 17.5, 18, 18.5, 19, 19.5, or 20 lbf or more, optionally as measured in accordance with ASTM D2261. In some embodiments, the fabric may have a tear strength in the fill direction of about 8 or 10 lbf to about 12, 14, 16, 18, or 20 lbf, optionally as measured in accordance with ASTM D2261. In some embodiments, the fabric may have a tear strength in the warp direction of about 8, 10, 12, or 14 lbf to about 16, 18, or 20 lbf, optionally as measured in accordance with ASTM D2261.

A fabric of the present invention may have tensile strength in the warp and/or fill direction of about 85 lbf or more, optionally as measured in accordance with ASTM D5034. In some embodiments, the fabric may have a tensile strength in the warp and/or fill direction of about 85, 90, 95, 100, 110, 120, 130, 140, 150, 160, 170, 180, 190, 200, 210, 220, 230, 240, or 250 lbf or more, optionally as measured in accordance with ASTM D5034. In some embodiments, the fabric may have a tensile strength in the fill direction of about 85, 90, 95, 100, 110, 120, 130, 140, 150, or 160 to about 170, 180, 190, 200, 210, 220, 230, 240, or 250 lbf, optionally as measured in accordance with ASTM D5034. In some embodiments, the fabric may have a tensile strength in the warp direction of about 85, 90, 95, 100, 110, 120, 130, 140, 150, 160, 170, or 180 lbf to about 190, 200, 210, 220, 230, 240, or 250 lbf, optionally as measured in accordance with ASTM D5034. In some embodiments, the fabric may have a tensile strength in the fill direction of about 140 lbf or more (e.g., about 140 to about 180, 200, or 250 lbf), optionally as measured in accordance with ASTM D5034. In some embodiments, the fabric may have a tensile strength in the warp direction of about 165 lbf or more (e.g., about 165 to about 200 or 250 lbf), optionally as measured in accordance with ASTM D5034. In some embodiments, a fabric of the present invention has a tensile strength in the warp and/or fill direction that is improved and/or increased (e.g., by at least about 5%, 10%, 15%, 20%, 25%, 30%, or more) compared to the tensile strength of a control fabric.

In some embodiments, a fabric of the present invention has a strength (e.g., tear strength and/or tensile strength), seam slippage, crock, flame resistance, and/or arc-flash resistance after about 200,000 cycles of fabric abrasion testing that is substantially the same as (e.g., within about +/−10% of) the strength (e.g., tear strength and/or tensile strength), seam slippage, crock, flame resistance, and/or arc-flash resistance of the fabric prior to fabric abrasion testing. The fabric abrasion testing may be measured in accordance with TM ASTM D4966 (Martindale Abrasion).

In some embodiments, a fabric of the present invention has minimal or no discoloration after about 10, 25, 50, 75, 100, 150, 160, 200, or more launderings compared to the color of the fabric prior to laundering and/or compared to a control fabric. Discoloration may be determined upon visual comparison with the human eye. In some embodiments, a fabric of the present invention after about 10, 25, 50, 75, 100, 150, 160, 200, or more launderings exhibits no visually perceptive color change compared to the color of the fabric prior to laundering.

A fabric of the present invention may have a CIE Delta E of less than about 10, 9, 8, 7, 6, 5, 4, 3, 2, or 1 at about 3, 6, 9, or 12 months or more (e.g., 3, 6, 9, or 12 months or more of outdoor exposure) and/or after exposure to 880, 1320, or 2200 kJ in accordance with AATCC 169 Option 3.

In some embodiments, a fabric of the present invention has increased and/or improved strength (e.g., tear strength and/or tensile strength), shrinkage, seam slippage, crock, shade consistency, color fastness, arc-flash resistance, and/or laundering properties compared to the strength (e.g., tear strength and/or tensile strength), shrinkage, seam slippage, crock, shade consistency, color fastness, arc-flash resistance, and/or laundering properties for a control fabric. In some embodiments, a fabric of the present invention may have a strength (e.g., tear strength and/or tensile strength), shrinkage, seam slippage, crock, shade consistency, color fastness, arc-flash resistance, and/or laundering properties that is/are substantially the same as (e.g., within about +/−10% of) the strength (e.g., tear strength and/or tensile strength), shrinkage, seam slippage, crock, shade consistency, color fastness, arc-flash resistance, and/or laundering properties for a control fabric.

A fabric and/or yarn of the present invention may be used to form a garment using methods known to those of skill in the art. Exemplary garments include, but are not limited to, shirts, pants, pullovers, jackets, coveralls, vests, gloves, and headwear.

The present invention is explained in greater detail in the following non-limiting examples.

EXAMPLES

Example 1

A fabric having an increased modacrylic fiber content was prepared (i.e., Fabric 1). The about 5.3 oz/sqy fabric had solution-dyed meta-aramid fibers in an amount of 54% by weight of the fabric, solution-dyed modacrylic fibers in an amount of 40% by weight of the fabric, solution-dyed para-aramid fibers in an amount of 5% by weight of the fabric and solution-dyed anti-static fibers in an amount of 1% by weight of the fabric.

A control fabric (i.e., Control Fabric) was also prepared having a weight of 5.3 oz/sqy and including solution-dyed meta-aramid fibers in an amount of 74% by weight of the fabric, stock dyed modacrylic fibers in an amount of 20% by weight of the fabric, solution-dyed para-aramid fibers in an amount of 5% by weight of the fabric and solution-dyed anti-static fibers in an amount of 1% by weight of the fabric. Fabric 1 and the Control Fabric were each a finished right hand twill woven fabric using standard textile techniques.

Each of the fabrics was tested for flame and arc resistance and each fabric passed the following tests ASTM D6413; AATCC 61; ASTM D3776; ASTM D434; AATCC 135, Method 3, V, A, iii; ASTM D2261; and ASTM D5034. The results for Fabric 1 and the Control Fabric are provided in Tables 1 and 2, respectively.

TABLE 1

Tests results for Fabric 1.

| Test Method | Test Description | Standard | Pass/Fail | Average |
|---|---|---|---|---|
| ASTM D6413 | AFTERFLAME L | <2 Seconds | PASS | 0 seconds |
| ASTM D6413 | AFTERFLAME L 10 MW | <2 Seconds | PASS | 0 seconds |
| ASTM D6413 | AFTERFLAME W | <2 Seconds | PASS | 0 seconds |
| ASTM D6413 | AFTERFLAME W 10 MW | <2 Seconds | PASS | 0 seconds |
| ASTM D6413 | CHAR L | <6" | PASS | 2" |
| ASTM D6413 | CHAR L 10 MW | <6" | PASS | 1.95" |
| ASTM D6413 | CHAR W | <6" | PASS | 2.2" |
| ASTM D6413 | CHAR W 10 MW | <6" | PASS | 2" |
| AATCC 61 | CROCK DRY | ≥4.5 | PASS | 5 |
| AATCC 61 | CROCK WET | ≥4.5 | PASS | 4.5 |
| ASTM D3776 | FABRIC WT | ≥5.04 oz/sqy | PASS | 5.26 oz/sqy |
| ASTM D434 | SEAM SLIPPAGE FILL | ≥25 lbf | PASS | 61.91 lbf |
| ASTM D434 | SEAM SLIPPAGE WARP | ≥25 lbf | PASS | 79.2 lbf |
| AATCC 135, Method 3, V, A, iii | SHRINK L 10 MW | <3% | PASS | 2% |
| AATCC 135, Method 3, V, A, iii | SHRINK L 5 MW | <3% | PASS | 1.88% |
| AATCC 135, Method 3, V, A, iii | SHRINK LENGTH 1 MW | <3% | PASS | 1.33% |
| AATCC 135, Method 3, V, A, iii | SHRINK W 10 MW | <3% | PASS | 1.22% |
| AATCC 135, Method 3, V, A, iii | SHRINK W 5 MW | <3% | PASS | 1% |
| AATCC 135, Method 3, V, A, iii | SHRINK WIDTH 1 MW | <3% | PASS | 0.66% |
| ASTM D2261 | TEAR FILLING | ≥7.5 lbf | PASS | ≥10.5 lbf |
| ASTM D2261 | TEAR WARP | ≥7.5 lbf | PASS | ≥15 lbf |
| ASTM D5034 | TENSILE MD | ≥85 lbf | PASS | ≥188 lbf |
| ASTM D5034 | TENSILE XD | ≥85 lbf | PASS | ≥167 lbf |

TABLE 2

Tests results for Control Fabric.

| Test Method | Test Description | Standard | Pass/Fail | Average |
|---|---|---|---|---|
| ASTM D6413 | AFTERFLAME L | <2 Seconds | PASS | 0 seconds |
| ASTM D6413 | AFTERFLAME L 10 MW | <2 Seconds | PASS | 0 seconds |
| ASTM D6413 | AFTERFLAME W | <2 Seconds | PASS | 0 seconds |
| ASTM D6413 | AFTERFLAME W 10 MW | <2 Seconds | PASS | 0 seconds |
| ASTM D6413 | CHAR L | <6" | PASS | 1.8" |
| ASTM D6413 | CHAR L 10 MW | <6" | PASS | 1.9" |
| ASTM D6413 | CHAR W | <6" | PASS | 2" |
| ASTM D6413 | CHAR W 10 MW | <6" | PASS | 2" |
| AATCC 61 | CROCK DRY | ≥4.5 | PASS | ≥5 |
| AATCC 61 | CROCK WET | ≥4.5 | PASS | ≥4.5 |
| ASTM D3776 | FABRIC WT | ≥5.04 oz/sqy | PASS | ≥5.27 oz/sqy |
| ASTM D434 | SEAM SLIPPAGE FILL | ≥25 lbf | PASS | ≥50.8 lbf |

TABLE 2-continued

Tests results for Control Fabric.

| Test Method | Test Description | Standard | Pass/Fail | Average |
|---|---|---|---|---|
| ASTM D434 | SEAM SLIPPAGE WARP | ≥25 lbf | PASS | 61.4 lbf |
| AATCC 135, Method 3, V, A, iii | SHRINK L 10 MW | <3% | PASS | 2.33% |
| AATCC 135, Method 3, V, A, iii | SHRINK L 5 MW | <3% | PASS | 2.11% |
| AATCC 135, Method 3, V, A, iii | SHRINK LENGTH 1 MW | <3% | PASS | 2% |
| AATCC 135, Method 3, V, A, iii | SHRINK W 10 MW | <3% | PASS | 2.66% |
| AATCC 135, Method 3, V, A, iii | SHRINK W 5 MW | <3% | PASS | 2.11% |
| AATCC 135, Method 3, V, A, iii | SHRINK WIDTH 1 MW | <3% | PASS | 2% |
| ASTM D2261 | TEAR FILLING | ≥7.5 lbf | PASS | ≥12.5 lbf |
| ASTM D2261 | TEAR WARP | ≥7.5 lbf | PASS | ≥15.8 lbf |
| ASTM D5034 | TENSILE MD | ≥85 lbf | PASS | ≥164 lbf |
| ASTM D5034 | TENSILE XD | ≥85 lbf | PASS | ≥138 lbf |

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A fabric comprising:

a plurality of yarns, wherein each yarn of the plurality of yarns comprises fibers, and the fibers comprise solution-dyed modacrylic fibers, solution-dyed meta-aramid fibers, anti-static fibers, and optionally solution-dyed para-aramid fibers, wherein the fabric comprises:

40% to about 50% solution-dyed modacrylic fibers by weight of the fabric;

about 50% to about 60% solution-dyed meta-aramid fibers by weight of the fabric;

about 0.1% to about 2% anti-static fibers by weight of the fabric; and about 0% to about 10% solution-dyed para-aramid fibers by weight of the fabric, wherein the fabric meets the requirements set forth in ASTM F1506, and wherein the fabric has a protection to weight ratio of 1.5 or more (arc rating (cal/cm$^2$) as measured in accordance with ASTM F1959:weight of the fabric).

2. The fabric of claim 1, wherein the fabric comprises about 50% to about 55% solution-dyed meta-aramid fibers by weight of the fabric.

3. The fabric of claim 1, wherein the fabric is woven or knit.

4. The fabric of claim 1, wherein the anti-static fibers are solution-dyed fibers.

5. The fabric of claim 1, wherein the fabric comprises about 95% or more solution-dyed fibers by weight of the fabric.

6. The fabric of claim 1, wherein the fabric has a basis weight of about 2 ounces per square yard (osy) to about 15 osy.

7. The fabric of claim 1, wherein the fabric has about 50 to about 70 picks per inch (PPI).

8. The fabric of claim 1, wherein the fabric is flame-resistant.

9. The fabric of claim 1, wherein the fabric is UL compliant and/or the fabric meets or exceeds the requirements set forth in ASTM D6413, NFPA 70E, NFPA 2112, NFPA 1975, Canadian Standard CGSB 155.20, and/or Canadian Standard CGSB 155.22.

10. The fabric of claim 1, wherein the fabric has a seam slippage in a warp and/or fill direction of greater than 50 lbf, as measured in accordance with ASTM D434.

11. The fabric of claim 1, wherein the fabric has a shrinkage in length and/or width direction after 25 launderings of less than about 3%, as measured in accordance with TM AATCC 135, Method 3, V, A, iii.

12. The fabric of claim 1, wherein the fabric has a tear strength in a warp and/or fill direction of at least about 7.5 lbf, as measured in accordance with ASTM D2261.

13. The fabric of claim 1, wherein the fabric has a tensile strength in a warp and/or fill direction of at least about 85 lbf, as measured in accordance with ASTM D5034.

14. The fabric of claim 1, wherein the fabric does not melt or drip, has an after-flame of less than 2 seconds, and has a char length of less than 6 inches, as tested in accordance with ASTM F1506 and/or ASTM D6413.

15. The fabric of claim 14, wherein the fabric, after 25 launderings, does not melt or drip, has an after-flame of less than 2 seconds, and has a char length of less than 6 inches, as tested in accordance with ASTM test method D6413.

16. The fabric of claim 1, wherein the fabric has a laundering rating of at least 4, as measured in accordance with TM AATCC 61 2A.

17. The fabric of claim 1, wherein the fibers consist of solution-dyed modacrylic fibers, solution-dyed meta-aramid fibers, and anti-static fibers.

18. The fabric of claim 1, wherein the fabric comprises solution-dyed para-aramid fibers in an amount of about 1% to about 10% by weight of the fabric.

19. The fabric of claim 1, wherein the fabric has a basis weight of about 2 osy to about 7.5 osy.

20. The fabric of claim 1, wherein each yarn of the plurality of yarns comprises about 90% to about 98% solution-dyed meta-aramid fibers and solution-dyed modacrylic fibers by weight of the yarn.

21. The fabric of claim 1, wherein the fibers consist of solution-dyed modacrylic fibers, solution-dyed meta-aramid fibers, anti-static fibers, and solution-dyed para-aramid fibers.

22. A method of forming a garment, the method comprising:

providing the fabric of claim 1.

* * * * *